United States Patent [19]

Anderson

[11] 4,141,447

[45] Feb. 27, 1979

[54] TRAY SUPPORT FOR SHIPPING WOUND MATERIAL PACKAGES

[75] Inventor: Russell L. Anderson, Mechanicsburg, Pa.

[73] Assignee: Avtex Fibers Inc., Valley Forge, Pa.

[21] Appl. No.: 885,406

[22] Filed: Mar. 10, 1978

[51] Int. Cl.[2] ..... B65D 85/676

[52] U.S. Cl. ..... 206/392; 206/396; 206/408; 206/443; 206/493

[58] Field of Search ..... 206/391, 392, 395, 396, 206/397, 408, 443, 493

[56] References Cited

U.S. PATENT DOCUMENTS

| | | | |
|---|---|---|---|
| 2,699,866 | 1/1955 | Russell, Jr. | 206/392 |
| 2,818,974 | 1/1958 | Talbot | 206/392 |
| 2,860,773 | 11/1958 | Zackheim | 206/408 |
| 2,938,625 | 5/1960 | Browning et al. | 206/392 |
| 3,229,812 | 1/1966 | Metzger | 206/396 |
| 3,246,742 | 4/1966 | Coe | 206/396 |
| 3,258,116 | 6/1966 | Goerke | 206/392 |
| 3,621,995 | 11/1971 | Francis | 206/493 |

*Primary Examiner*—William Price
*Assistant Examiner*—Bruce H. Bernstein
*Attorney, Agent, or Firm*—Arthur R. Eglington

[57] ABSTRACT

The shipping support tray of this invention comprises a single containerboard element containing integral members cut in the board to form a plurality of interlocking post elements for supporting and positioning tubes of wound yarn in a spaced relationship during shipment. The one element serves as both a base and top tray support.

13 Claims, 6 Drawing Figures

TRAY SUPPORT FOR SHIPPING WOUND MATERIAL PACKAGES

This invention relates generally to the support of a plurality of articles in spaced configuration within a unit package. It also relates to a packaging carton which is adapted for mounting and shipping a plurality of wound filament bobbins or pirns arranged in multi-layer form. More particularly, it relates to a novel shipping carton component which serves as the common post tray support and facilitates protection and handling of the yarn pirns in shipping.

A major share of textile fibers produced in yarn form must be packaged to be processed by machinery adapted to receive the yarn in the form of bobbins for weaving or knitting of fabrics. The bobbins are usually shipped in cartons designed to protect the wound yarn from abrasion damage. In order to so protect the yarn, the yarn package pirns are either individually wrapped, or are supported in fixed, spaced positions within the shipping case, to avoid contact between themselves or with other packed materials.

Shipping cartons having separator elements between layers of bobbin are known in the art. These separator elements usually comprise one or more thicknesses of corrugated containerboard, some of which are scored or punched to provide extensions for rigidly positioning and spacing the bobbins. For example, various U.S. Patents teach the use of two or more types of modified corrugated cardboards to provide anchoring posts to hold the yarn pirns.

Otis, U.S. Pat. No. 2,074,420, discloses a display device wherein the desired display is cut from the plane of a flexible material along all but one side which serves as a hinge when the display is raised from the plane of the flexible material. A second member is cut in similar manner from the flexible material and when raised, locks with and serves to support the display in an upright position.

Bender, U.S. Pat. No. 3,094,211, teaches a platform separator consisting of three elements to form structurally reinforced mounting posts for bobbin spools.

Prossen, U.S. Pat. No. 2,642,183, teaches a yarn shipping carton where yarn pirns are vertically positioned by perpendicularly arranged interlocking members, in either of two embodiments, but both requiring a three piece assembly to form the supporting tray and positioning posts.

Prossen, U.S. Pat. No. 2,710,689, teaches a single scored and cut cardboard sheet which contracts into raised anchoring ridges but requires a separate intermediate reinforcing sheet 23 between layers, with significant wasted board cutouts.

Kitchell, U.S. Pat. No. 3,319,866, teaches an inner packing element for tubing formed from two dissimilar punched blanks that are intermeshed to form one post support; a plurality of packages require just as many punched blanks.

Leavitt, U.S. Pat. No. 2,975,892, shows two blanks of different cut designs which assemble in a complementary manner to form a post tray that holds the tube bottoms of an upper layer and the tube tops of a lower layer of yarn cones.

All of the afore-described prior art cone or tube support trays require two or three distinctly different corrugated blanks or elements to be assembled into one tray of support posts. Their attendant higher costs of shipping cartons, requiring multi-design tray elements, seems manifest.

It is an object of the present invention to provide a simplified post tray element for shipping packages of yarn or other articles damageable by random contact abrasion.

It is another object to provide a single support tray in a package carton satisfactory as both a top and a bottom support element for the spaced apart yarn pirns during shipment.

Still another object is to provide a cut and scored containerboard sheet from which the pirn spacing posts or elements can be erected with substantially less manual assembly time than required by prior art post tray devices.

These and other objects and advantages are achieved by the present invention, and will become apparent to one skilled in the subject art, from the following description, reference being made to the accompanying drawings, in which.

Figure 1:
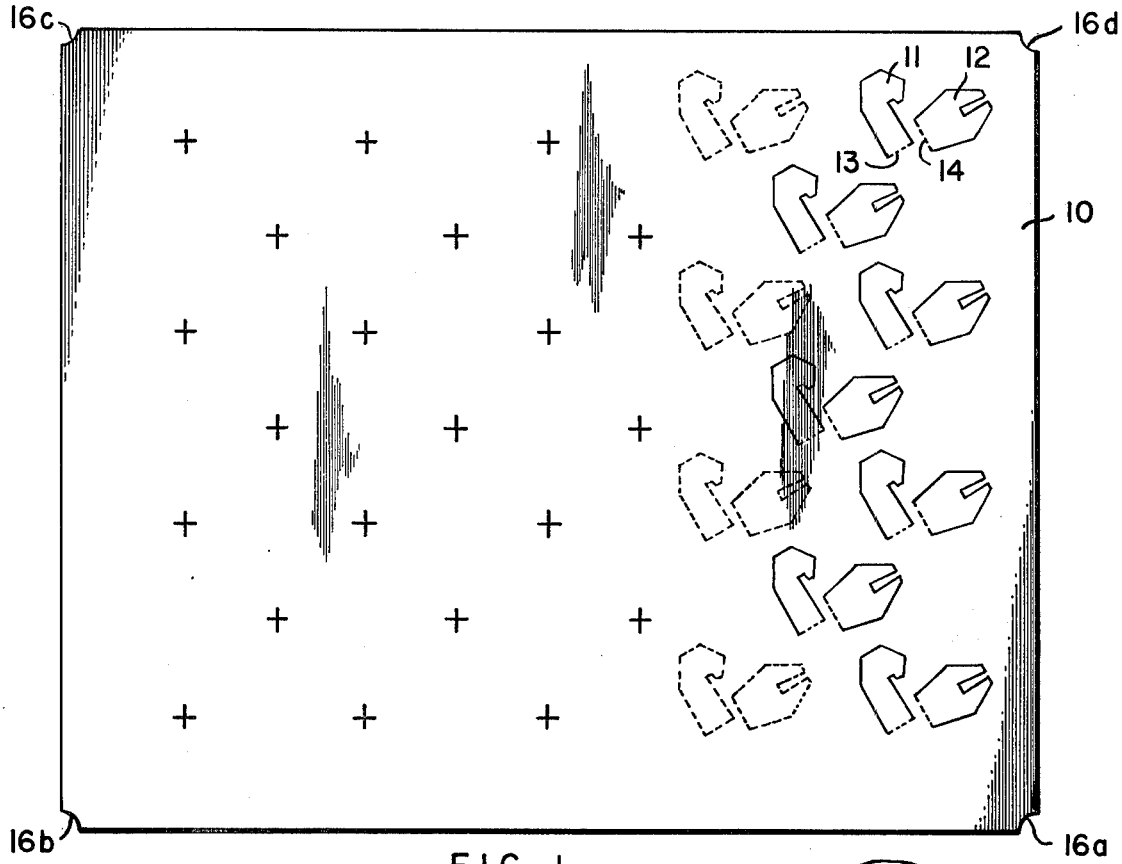
FIG. 1 is a plan view of the blank board, illustratively punched and scored, which serves both as the base and overlay portions of the post tray supports.
Figure 4:
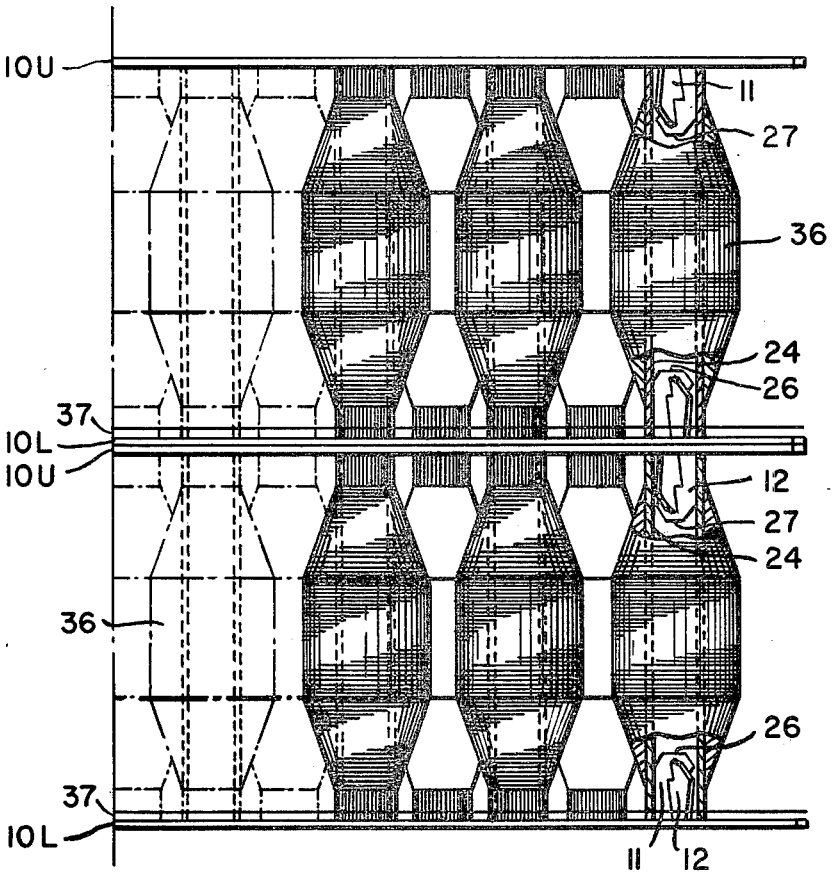
Figure 5:
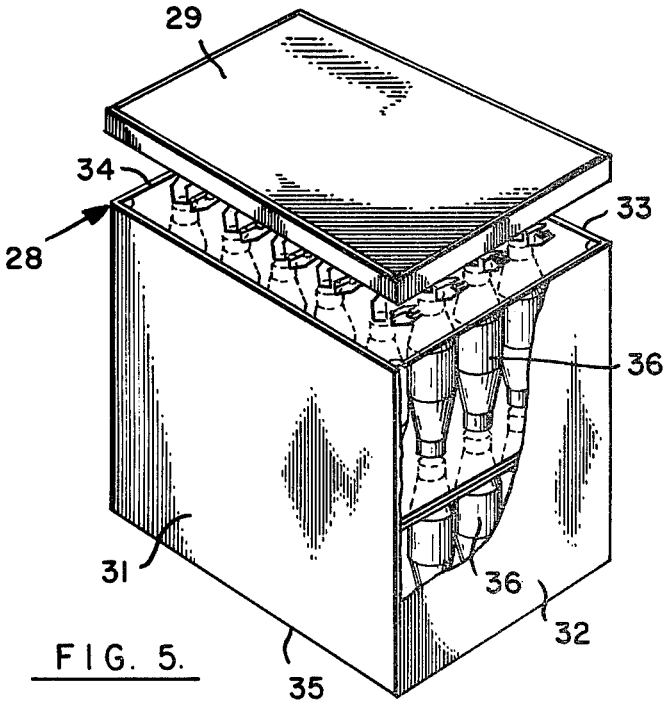
Figure 6:
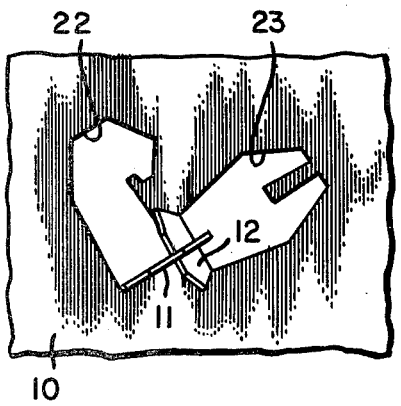

FIG. 4 is an elevational view, with portions broken away, of a plurality of pirns of material in stacked relation with assembled post trays of this invention; and FIG. 5 is a pictorial view of a loaded shipping carton embodying the post trays of invention; and FIG. 6 is a fragmentary top plan view, on an enlarged scale, of one area of the board of FIG. 1, showing the mating members engaged in the erect locking position forming a support post.

According to the invention, a pair of "pirn support" trays are used for packaging and transfer of yarn wound on a cylindrical hollow support tube or pirn. The trays are made of a flat, rigid base sheet such as corrugated containerboard, and include a plurality of aligned posts integral with the base sheet used to receive either end of the hollow support tubes. Each post is comprised of a pair of interlocking members which, when raised from the base sheet lie in planes perpendicular to each other and become locked by a tongue and slot arrangement to form a rigid unitary support for the tube. An identical tray, with a number of similar posts, is placed on top of the yarn tubes to engage the upper ends of the hollow tubes.

This novel configuration permits positive locking without the use of adhesives and superior strength from the 90° hinged axes versus the parallel hinge orientation of prior art tube supports.

Referring now to the drawing, and particularly FIG. 1, the reference numeral 10 generally indicates a one-piece corrugated containerboard of rectangular shape (measuring $25\frac{5}{8}'' \times 32\frac{5}{8}''$ or 65.0875 cm × 82.8675 cm in one embodiment), from which both the base and top sheet of the novel post tray design of this invention is formed. The blank is cut through and also partially scored to provide spaced apart pairs of mating members 11 and 12, the bases of which, 13 and 14 respectively, are only scored to permit folding outwardly upon application of pressure so as to lock the members in vertical relationship out of the plane of the containerboard.

In the depicted embodiment, four horizontal rows of five post positions are interspersed by three horizontal rows of four post positions and present a total of 32 positions. All or only a portion of these support posts may be used to mount yarn pirns in spaced relationship, dependent upon the diameter of the yarn-wound pirns, or the number of pirns to be placed in each layer as a matter of convenience.

Figure 2:
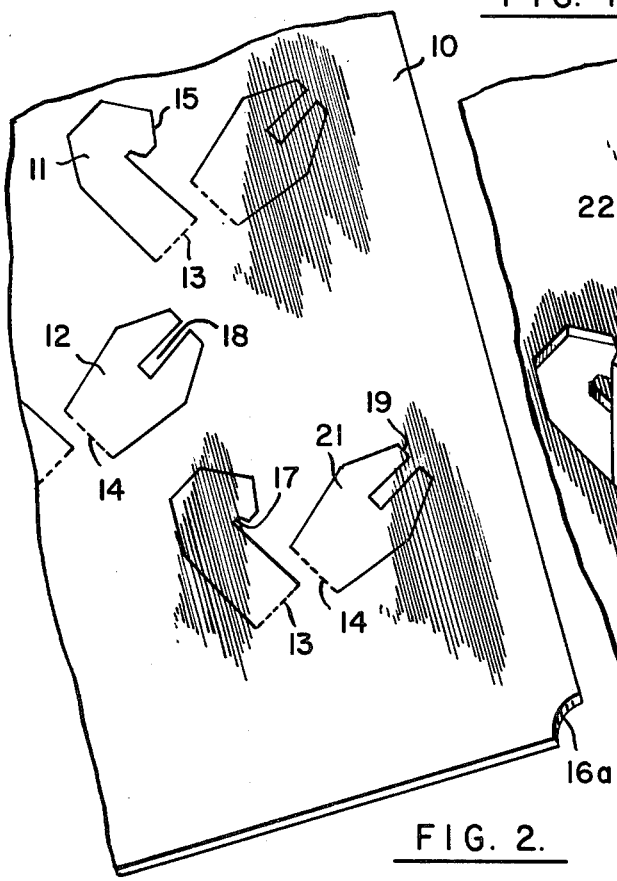
FIG. 2 is a fragmentary perspective view, on an enlarged scale, of one corner of the scored and punched board of FIG. 1, showing the mateable members in the plane of the board with their scored bases in spaced, perpendicular juxtaposition.
Figure 3:
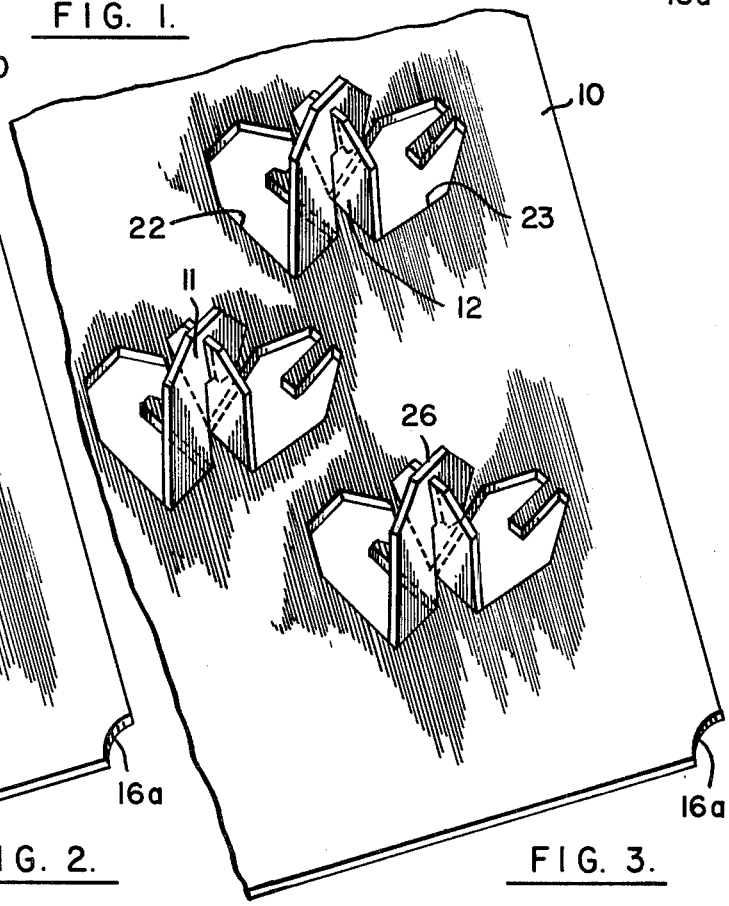
FIG. 3 is a fragmentary perspective view, on an enlarged scale, of the board of FIG. 1, but with the mating members displaced from the plane of the blank board to engage one another in an erect locking posture.

It is apparent that each of mating members 11 and 12 are completely cut out on most of their peripheries, but only scored along their bases, so that when they are pressed from the plane of board 10, they form projections hingedly connected to the base sheet along bases 13 and 14 respectively, in perpendicular juxtaposition planes, as will be more readily seen in FIGS. 2 and 3, which are enlarged partial views of the sheet of FIG. 1.

Sheet 10 is optionally provided with notched-out openings, 16*a* thru 16*d*, in each corner. These aid in loading and removing of the trays into and from a shipping carton (See FIG. 5).

In one embodiment of this invention, the scored hinges 13 and 14 are spaced apart a sufficient distance to provide a reinforcing space between them when in an outwardly disposed position. Spacing and length of hinges are dependent on the inside diameter of the hollow tube being supported. They are oriented on a 60°/30° bias of the corrugated medium to utilize the bending strength of the fluted medium in all directions.

In one embodiment, one of the mateable projections, which may be described as the male member, presents an inverted J-shaped configuration when in the upright position, thus defining an inwardly disposed notch 17 adapted to lockably engage the other bifurcated projection, or female member 12, the latter having a slotted groove 18 extending inwardly from the upper surface 19 thereof and terminating intermediate the opposing end or base of the female member.

While member 12 has an essentially rectangular configuration, it is preferably formed with a bulging middle section 21 which tapers inwardly toward either end of the member. The bulging midriff 21 serves two functions; one, compensating for the reduced strength of the bifurcated female member; and, two, insuring a pressure fit with the inner diameter of the hollow tube component of the loaded yarn pirn.

In a preferred embodiment, this bulging section has a maximum width that sufficiently exceeds the inner diameter of the hollow tube or pirn so that the pirn is mountable thereon with pressure and is retained in frictional engagement therewith during shipping.

The cut and scored boards are adapted for positioning of the tube or pirn support posts by either manual or mechanical means. In this operation, the male members are pressed outwardly into a substantially upright position. While maintained in this position, the female members are pressed outwardly into a like upright position until slots 18 slip under the J-shaped ends of the mating male members and into the notches 17 whereby the mating members are in locked positions. In a mechanical operation, the board may be placed on a frame having suitable upstanding posts adapted to force the male members into and maintain them in a substantially upright position (not shown). Movable posts are adapted to force the female members upwardly and press them into an upright position until slots 18 slip under the J-shaped ends and into the notches 17 of the mating male members. The leading edge 15 of the male member 11 is beveled to allow the base of slot 18 to slide down the inclined plane provided, forcing the male member to spring up, and then drop back down, forming a positive locking of the two members.

The resulting upright and locked projections will then appear as depicted in FIGS. 3, 4 and 6. The bottom tray is now in a posture to be manually mounted with material-loaded pirns or bobbins. The plurality of board orifices 22 and 23 remaining in tray 10 (in FIGS. 3 and 6) should not cause a significant structural weakness provided the board thickness and post positions are appropriately spaced to maintain the physical integrity of the tray in shipment.

The elevational view, FIG. 4, shows the pirn packages assembled for loading into a shipping carton in a dual layer, and anchored by the support posts of this invention. It is shown from its lesser width using a board as shown in FIG. 1 and thus loaded with 32 pirns per layer for shipment, though the tray can support a lesser number. A broken out portion of the right side pirns depicts the inner hollow tubes 24 of the pirns disposed in telescopic and frictional engagement with the upwardly and downwardly disposed support posts 26 and 27 of trays 10L and 10U.

With certain wound yarn pirns standing on the order of 17 inches (42.5 cm) in height, an optional separate bottom pad or pirn support board, may be included. It would provide a circumferentially flat surface for the lower edge of the longer pirn or yarn tubes. However, it would not be needed with shorter height pirns.

This support board (not shown in the drawing) would be a sheet of a single-wall containerboard with essentially circular cutouts, sized to slip freely over the locked erect upward projections 26, thereby essentially covering orifices 22 and 23. Typically, this support sheet would have 32 circular holes disposed in a like number of rows and spacings as are the 32 projections of the tray design of FIG. 1.

In FIG. 5, there is shown a shipping container, generally designated 28, comprising a paperboard carton with a top 29, rigid upright sides 31, 32, 33 and 34 and bottom 35. Removable cover or top 29 permits top loading, and later removal, of each of the pirn layers as a unit. Each of the pirn layers has subjacent support from the platform formed by the lower tray of its assembly, and reinforced by the upper tray of the pirn layer below it.

The carton is formed from corrugated board, or cardboard, or other suitable material, and in which is contained a plurality of yarn packages, in two or more layers, such as pirns 36, seen packed and loaded for shipping in the partially broken away perspective view of FIG. 5. The identical novel post tray forms the lower and upper anchoring supports 10L and 10U, respectively.

It is to be understood that the foregoing detailed description is given merely by way of illustration of preferred embodiments and that many variations may be made without departing from the spirit and scope of my invention.

I claim:

1. A post tray article for mounting aligned and spaced pirns and bobbins bearing wound materials comprising:

(a) a single one-piece flat, rigid base sheet, and (b) a plurality of spaced pairs of outwardly extendable mating members formed in the single base sheet defined by cuts and a single scored line at the base of each member, the scored lines of mating members being spaced from, and arranged perpendicularly to each other so that upon folding mating members outwardly of the base sheet along their scored bases into positions substantially perpendicular to the base sheet, the mating members are in planes at substantially right angles to each other and interlock to form a rigid, supporting post integral with said base sheet.

2. The article of claim 1 wherein the base sheet is corrugated containerboard and one of the mating members presents an inverted J-shaped configuration in the upright position and defines an inwardly disposed notch adapted to lockably engage the second of the mating members, the latter having a slotted groove disposed centrally therein and extending inwardly, said second member having an essentially rectangular configuration.

3. The article of claim 2 wherein the first mating member is provided with a leading edge beveled so as to allow the base of the slotted groove of second mating member to slide down the inclined plane so provided forcing an upward then downward action of the first member and forming a positive locking of the members.

4. The article of claim 2 wherein said second mating member is provided with a bulging middle section tapering inwardly to either end thereof.

5. A post tray assembly for packaging aligned and spaced apart pirns and bobbins bearing wound materials comprising:

(a) A lower single component post tray, and (b) An upper single component post tray each of said post trays being as defined in claim 1, and having disposed thereon integral rigid supporting posts, said post trays being maintained in spaced relationship by a plurality of pirns and bobbins positioned on corresponding rigid, support posts on said lower and upper post trays.

6. The tray construction of claim 5 comprises two mateable members, with the first of the mateable members having an inverted J-shaped configuration in the erect position with an inwardly disposed notch adapted to lockably engage the slotted portion of the second mateable member, the latter having a rectangular configuration with a bulging middle section, tapering inwardly toward either end of the projection.

7. The tray construction of claim 6 wherein the bulging middle section of the second of the mateable members has a maximum width that sufficiently exceeds the inner diameter of the hollow tube component of the pirn so that said pirn is pressure mounted thereon and is retained in frictional engagement thereon.

8. The tray assembly of claim 6 wherein the first mating member is provided with a leading edge beveled so as to allow the base of the slotted groove of second mating member to slide down the inclined plane so provided forcing an upward then downward action of the first member and forming a positive locking of the members.

9. A yarn pirn package comprising:

(a) at least two superposed layers of spaced yarn pirns, each of such pirns being of a hollow, essentially frustroconical forms, (b) a pair of post trays each of which is disposed on the opposing ends of each layer of the yarn pirns and in telescopic registration with a like number of the hollow tube interior of said pirns, (c) the post trays are formed from an identically constructed upper and lower sheet each formed of a single one piece, flat rigid base sheet, and (d) each of said single one-piece sheets being identically scored and cut to provide a plurality of spaced pairs of outwardly extendable mating members formed in the base sheet defined by cuts and a single scored line at the base of each member, the scored lines of the mating members being spaced from, and arranged perpendicularly to each other so that upon folding mating members outwardly of the base sheet along their scored bases into positions substantially perpendicular to the base sheet, the mating members are in planes at substantially right angles to each other and interlock to form a rigid, supporting post.

10. The pirn package of claim 9 wherein one of the mating members presents an inverted J-shaped configuration in the upright position and defines an inwardly disposed notch adapted to lockably engage the second of the mating members, the latter having a slotted groove disposed centrally therein and extending inwardly, and said second member having an essentially rectangular configuration.

11. The package of claim 10 wherein said second member is provided with a bulging middle section tapering inwardly toward either end thereof.

12. The yarn package of claim 11 wherein the bulging middle section of the second mating member has a maximum width that sufficiently exceeds the inner diameter of the hollow tube component of the pirn, so as to be pressure mounted thereon and be retained in frictional engagement therewith.

13. The pirn package of claim 10 wherein the first mating member is provided with a leading edge beveled so as to allow the base of the slotted groove of second mating member to slide down the inclined plane so provided forcing an upward then downward action of the first member and forming a positive locking of the members.

* * * * *